United States Patent [19]

Maier et al.

[11] 4,002,180

[45] Jan. 11, 1977

[54] HAIR CURLER

[75] Inventors: Eugene C. Maier; Lila M. Maier, both of Moscow, Idaho

[73] Assignee: The Raymond Lee Organization, Inc., New York, N.Y. ; a part interest

[22] Filed: Oct. 6, 1975

[21] Appl. No.: 619,643

[52] U.S. Cl. ..... 132/39

[51] Int. Cl.[2] ..... A45D 2/02

[58] Field of Search ..... 132/39, 40, 42, 36.2, 132/38, 39

[56] References Cited

UNITED STATES PATENTS

| | | | |
|---|---|---|---|
| 1,704,769 | 3/1929 | Shelton | 132/33 |
| 2,308,819 | 1/1943 | McFadden et al. | 132/38 |
| 2,391,284 | 12/1945 | Weiss | 132/39 |

*Primary Examiner*—G.E. McNeill

*Attorney, Agent, or Firm*—Daniel Jay Tick

[57] ABSTRACT

A support member of pliable material supports hair wound around it. A ribbon type member extends from the support member for wrapping around hair wound around the support member thereby holding the hair in position on the support member.

1 Claim, 4 Drawing Figures

HAIR CURLER

DESCRIPTION OF THE INVENTION

The present invention relates to a hair curler.

Objects of the invention are to provide a hair curler of simple structure, which is inexpensive in manufacture, used with facility and convenience, and functions efficiently, effectively and reliably to curl hair as desired with a minimum of discomfort, since it does not involve rigid, unyielding components on which the user must rest her or his head.

In order that the invention may be readily carried into effect, it will now be described with reference to the accompanying drawing, wherein.

Figure 1:
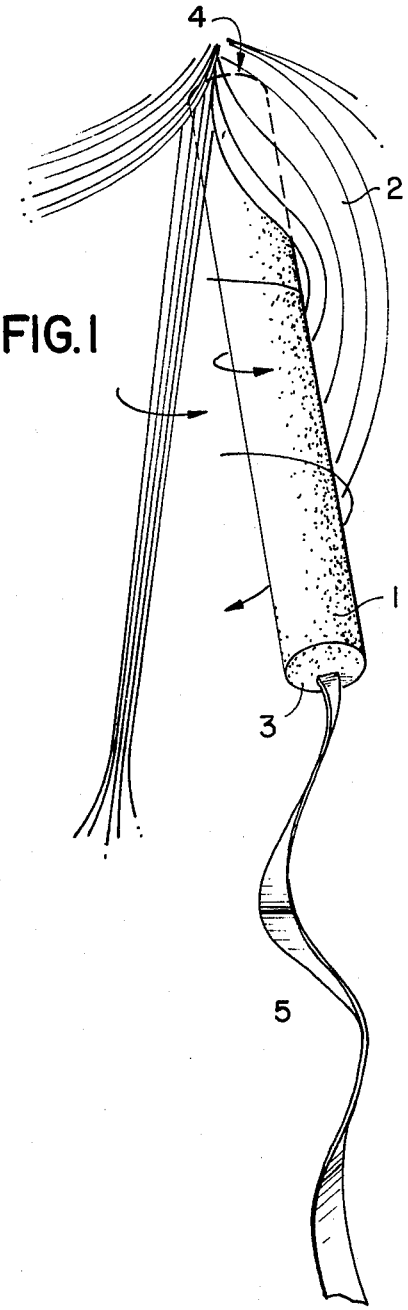
FIG. 1 is a perspective view of an embodiment of the hair curler of the invention.
Figure 2:
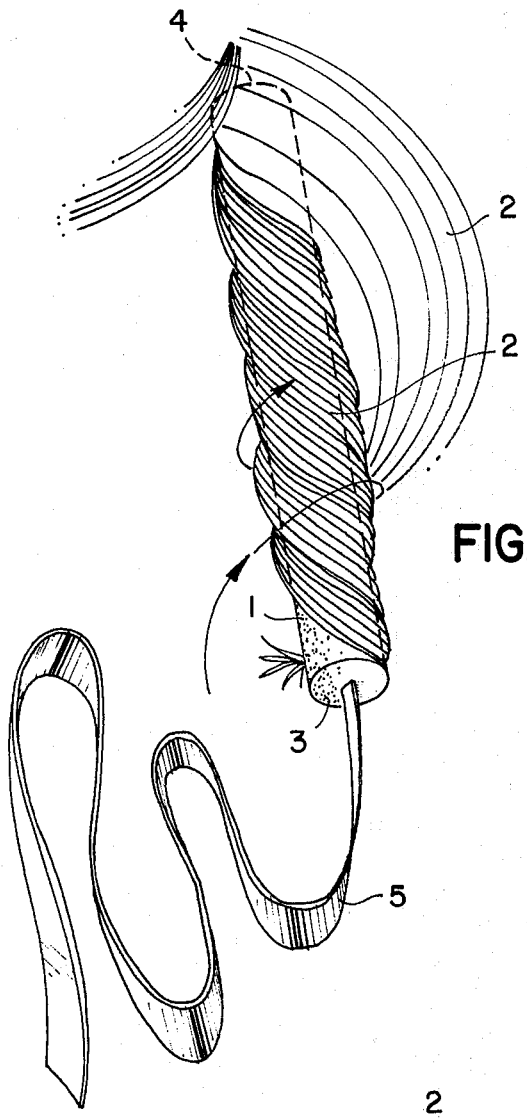
FIG. 2 is a perspective view of the embodiment of FIG. 1 with the hair of the user wound around it.
Figure 4:
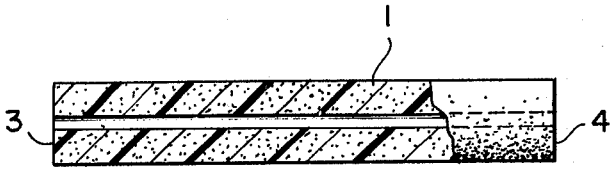
FIG. 4 is a partly cutaway, partly sectional view of an embodiment of the support member of the hair curler of the invention.

The support member 1 is of substantially elongated cylindrical configuration having a pair of spaced opposite ends 3 and 4 (FIGS. 1, 2 and 4).

Figure 3:
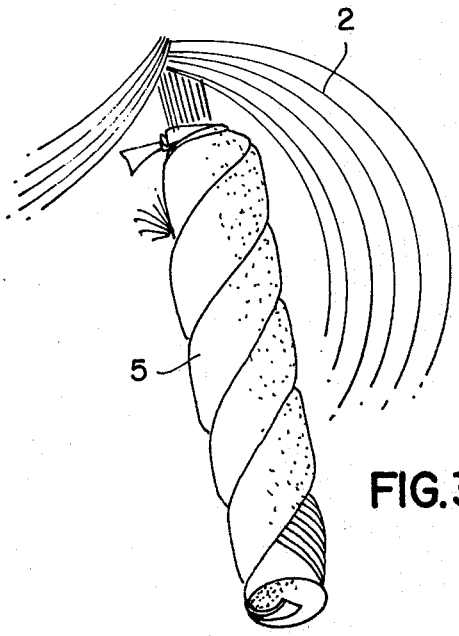
FIG. 3 is a perspective view of the embodiment of FIG. 1 with the ribbon type member wound around the hair which is wound around the support member thereof.

The hair curler further comprises a ribbon type member 5 (FIGS. 1 to 3) extending from the end 3 of the support member 1. The ribbon type member 5 is wrapped around hair wound around the support member 1 thereby holding the hair in position on said support member.

While the invention has been described by means of a specific example and in a specific embodiment, we do not wish to be limited thereto, for obvious modifications will occur to those skilled in the art without departing from the spirit and scope of the invention.

We claim:

1. A hair curler, comprising a support member of substantially pliable material for supporting hair wound around it, said support member being of substantially elongated unitary cylindrical configuration having a substantially smooth cylindrical surface and a pair of spaced opposite ends; and a ribbon type member extending from one of the ends of the support member for wrapping around hair wound around said support member thereby holding the hair in position on said support member.

* * * * *